US005593381A

United States Patent [19]

Tannenbaum et al.

[11] Patent Number: 5,593,381

[45] Date of Patent: Jan. 14, 1997

[54] SKIN AND TISSUE TREATMENT AND STIMULATION DEVICE AND METHOD

[75] Inventors: Joseph Tannenbaum, Jerusalem; Eli S. Pasternak, Petach Tikva, both of Israel

[73] Assignee: Neptune Pundak & Ayalon Ltd., Haifa, Israel; a part interest

[21] Appl. No.: 279,350

[22] Filed: Jul. 25, 1994

[51] Int. Cl.[6] ..... A61H 7/00; A61H 23/00

[52] U.S. Cl. ..... 601/93; 601/87; 601/84; 601/101; 601/108; 601/110; 601/134

[58] Field of Search ..... 601/87, 101, 107–114, 601/89, 93–95, 84, 134, 135, 85, 88

[56] References Cited

U.S. PATENT DOCUMENTS

| | | | |
|---|---|---|---|
| 767,593 | 8/1904 | Patchen | 601/107 X |
| 857,761 | 6/1907 | Schmidt | 601/113 X |
| 1,784,301 | 12/1930 | Mekler | 601/112 |
| 2,113,444 | 4/1938 | Erickson | 601/135 X |
| 2,234,102 | 3/1941 | Andres | 601/101 |
| 2,519,790 | 8/1950 | Quinn | 601/113 X |
| 2,526,190 | 10/1950 | Alvarez | 601/101 X |
| 3,968,789 | 7/1976 | Simoncini | 601/112 X |
| 4,014,324 | 3/1977 | Cellers | 601/112 |
| 4,088,128 | 5/1978 | Mabuchi | 601/108 X |
| 4,102,334 | 7/1978 | Muchisky | 601/108 |
| 4,549,535 | 10/1985 | Wing | 601/108 |
| 4,827,914 | 5/1989 | Kamazawa | 601/108 X |
| 5,140,979 | 8/1992 | Nakagawa | 601/108 |
| 5,300,095 | 4/1994 | Salazar | 601/108 X |
| 5,415,621 | 5/1995 | Campbell | 601/112 X |

*Primary Examiner*—Robert A. Hafer
*Assistant Examiner*—Brian E. Hanlon
*Attorney, Agent, or Firm*—Edward Langer

[57] ABSTRACT

A treatment and stimulation device provided as a compact, portable unit having an applicator capable of horizontal and vertical movements for manipulation of the skin and underlying tissue under electronic circuit control. In a preferred embodiment, the applicator is provided with reversible rotation directed against the skin to provide horizontal movement having uneven angles of deflection, and vertical up/down movement is supplied by a solenoid. By virtue of the electronic control, these movements are continuously variable, and can be integrated and finely controlled, to produce any desired physical stimulation effect on the skin and tissue, for medical or cosmetic purposes. The different kinds of receptors in the skin and tissue can be selectively activated, since they are frequency dependent and direction-force dependent. Even a small, localized skin area can be treated, and individually adjustable movements can be pre-programmed, to activate the center point of the area, or to refresh a larger surface area. The controllable movement of the applicator enables a large range of stimulation effects, especially useful in therapeutic treatment of the skin and tissue, for rehabilitation purposes, and for pain relief. The user can adjust the type of stimulation and intensity as needed, according to the individual stimulation threshold of the user.

20 Claims, 7 Drawing Sheets

SKIN AND TISSUE TREATMENT AND STIMULATION DEVICE AND METHOD

FIELD OF THE INVENTION

The present invention relates to skin treatment and stimulation devices, and more particularly, to a novel skin and underlying tissue treatment device providing physical stimulation of tissue, including muscles and nerves, through controlled manipulation of the skin surface.

BACKGROUND OF THE INVENTION

The human skin and underlying tissue contains numerous mechanoreceptors which are sensitive to touch, pressure, stretching and temperature. These receptors are distributed over the whole area of the human body in different depths. The sensitive area is known as the "receptive field", which exists in the skin and in the tissue below the skin, in the muscles, the sensory and motor nerves, in the wall of blood vessels, and surface membrane of the bone. The types of mechanoreceptors present are Merkel's Disk, Pacinian corpuscle, Meissner corpuscle, muscle and tendon spindles, neuromuscular junction or motor points, free nerve endings, proprioceptors and pilomotor in follicles. These are found the encapsulated sensory endings, in the dermal papillae, in the fingertips, soles, palms, scalp, tendons and genital organs etc.

These receptors are, under different conditions, sensitive in a selective fashion to stimulation parameters of forces applied to them, such as the direction, the power (mostly activated by a gentle force), and the frequency. By selective (or tuned) activation, these receptors signal the perception of the stimulation to the central nervous system, causing a comfortable relaxing sensation.

Stimulation of the skin and the underlying tissue by massage is also important in the case of injury, to improve and rehabilitate damaged tissue. In many cases, the use of controlled movement of skin and tissue is needed, and therefore, the direction, force and frequency must be accurately adjustable, to have an influence on the tissue. For example, the mechanical displacement of body fluids exerts a physical influence upon distribution of material in the vascular and lymphatic structures of such tissue. In any of these structures, the application of external forces would be expected to displace their contents, gaseous, fluid or semi-solid, into regions subjected to lesser pressure. As a result, the tissue returns to its natural homogeneous formation.

Known stimulation methods are based on stroking and application of pressure on the skin surface by a therapist, through finger depression and motion, or by mechanical devices. However, the therapist cannot develop the required directional movement with great accuracy, or in a constant rhythm, and it is difficult for the therapist to maintain these movements for long periods, due to fatigue, so the resulting stimulation effects are short term. Existing mechanical devices are typically inadequate.

It would therefore be desirable to provide a stimulation device for providing physical stimulation through controlled manipulation of the skin and underlying tissue.

SUMMARY OF THE INVENTION

Accordingly, it is a principal object of the present invention to overcome the above-mentioned disadvantages of existing manual and mechanical stimulation devices and methods and provide a skin and tissue treatment and stimulation device for providing controlled physical stimulation.

In accordance with a preferred embodiment of the present invention, there is provided a skin and tissue treatment and stimulation device comprising:

a housing;

electromechanical transducer means mounted in said housing and having applicator means mounted at an end thereof, said applicator means contacting the skin and tissue; and control means for applying electrical signals to said transducer means to control movement thereof, for controlled manipulation of the skin and tissue via said applicator means.

In the preferred embodiment, the inventive treatment and stimulation device comprises a compact, portable housing having a reversible motor and a solenoid (electromagnet) mounted therein, for providing an applicator with horizontal and vertical movements for manipulation of the skin and underlying tissue under electronic circuit control. Motorized rotation of the applicator is directed against the skin to provide horizontal movement, and vertical up/down movement is supplied by the solenoid. By virtue of the electronic control, these movements are continuously variable, and can be integrated and finely controlled, to produce any desired physical stimulation effect on the skin and tissue, for medical or cosmetic purposes.

Thus, the different kinds of receptors in the skin and tissue can be selectively activated, since they are frequency dependent and direction-force dependent. Even a small, localized skin area can be treated, and individually adjustable movements can be preprogrammed, to activate the center point of the area, or to refresh a larger surface area. The controllable movement of the applicator enables a large range of stimulation effects.

The controllable movements of the inventive stimulation device are especially useful in therapeutic treatment of the skin and tissue, for rehabilitation purposes, and for pain relief. The user can adjust the type of stimulation and intensity as needed, according to the individual stimulation threshold of the user.

In addition, the applicator can be applied against the skin under fluids containing medical ingredients, or with creams, using various applicator shapes for different applications.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
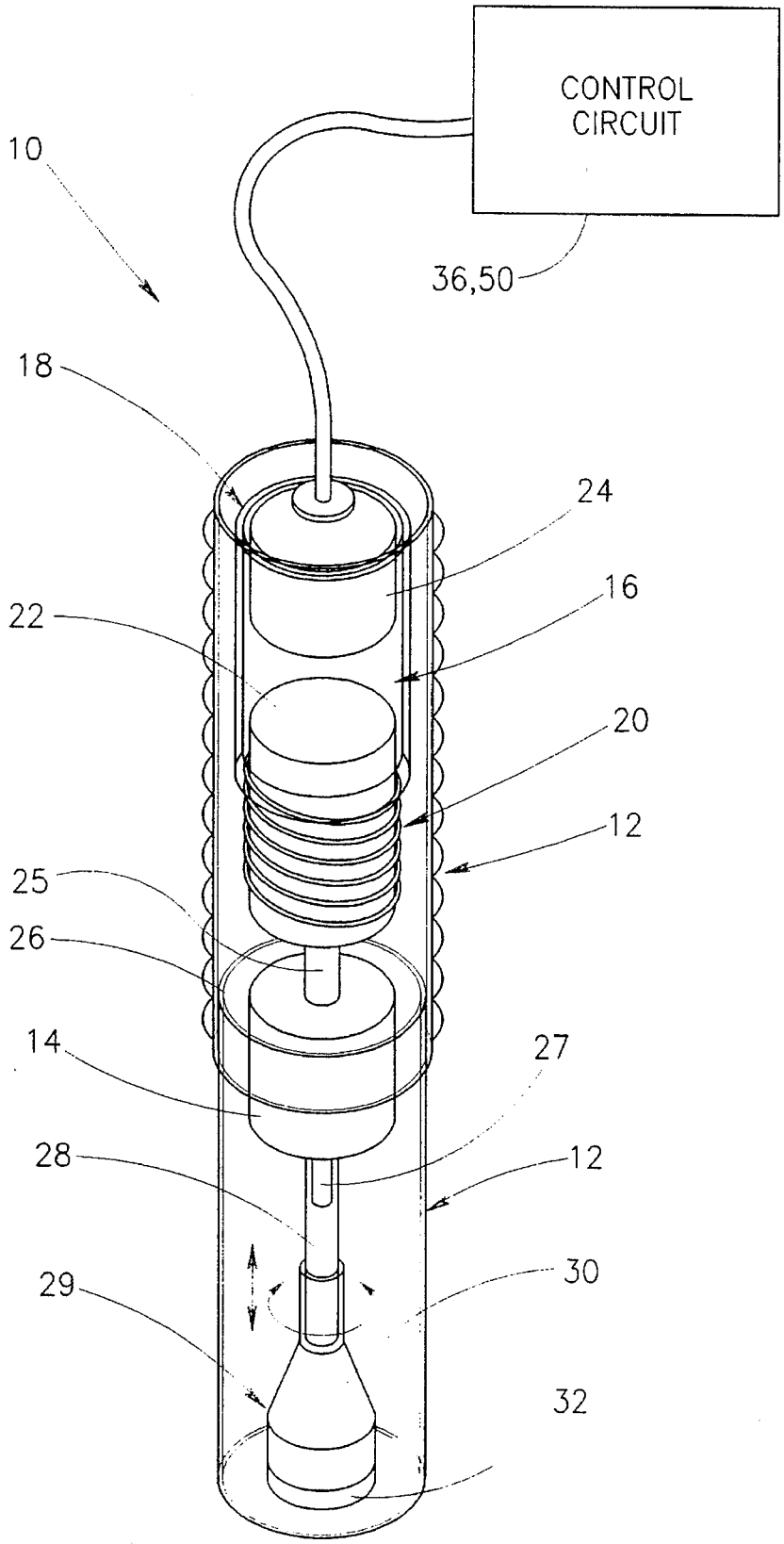
FIG. 1 is a perspective view of a preferred embodiment of skin and tissue treatment and stimulation device constructed and operated in accordance with the present invention.

Referring now to FIG. 1, there is shown a perspective view of a preferred embodiment of a skin and tissue treatment and stimulation device 10 constructed and operated in accordance with the principles of the present invention. Stimulation device 10 comprises a generally cylindrical housing 12 having disposed therein a DC motor 14, and a solenoid 16, comprising a coil 18 and a spring 20 retaining a movable, cylindrical iron core portion 22 apart from a fixed, cylindrical iron core portion 24. Motor 14 is mounted on movable portion 22 via a connection rod 25 and slides vertically therewith within a slider 26 in housing 12, and is restored to its initial position by spring 20.

Mounted as an extension of the shaft 27 of motor 14 is a coupling 28 having mounted at its distal end an applicator 29 comprising a connector 30, such as rubber, coated with a soft material 32, e.g., silicone. In accordance with the principles of the present invention, physical stimulation of the skin is provided by electronically controlled horizontal and vertical movements of surface 32 of applicator 29 against the skin. Housing 12 has a length adapted to expose applicator 29 as needed.

Figure 2:
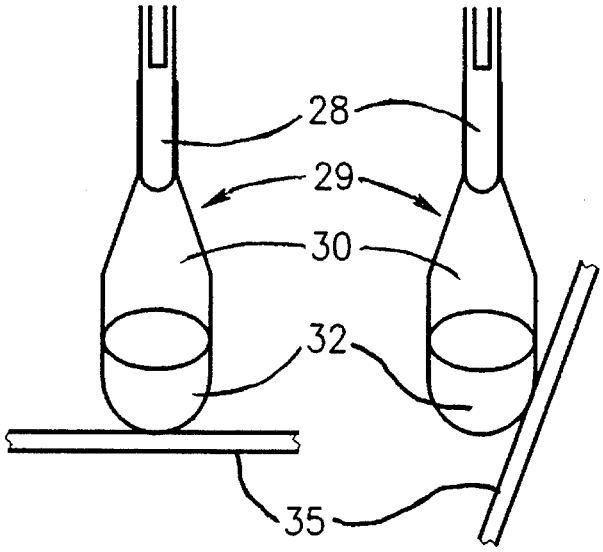
FIG. 2 illustrates an applicator portion of the stimulation device of FIG. 1, in different modes of application.
Figure 3:
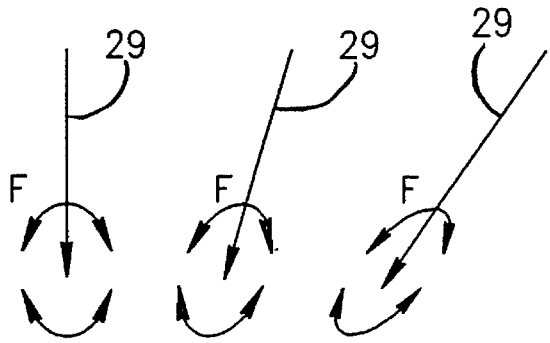
FIG. 3 is a schematic diagram of a set of vector forces associated with the modes of application shown in FIG. 2.

FIGS. 2–3 are, respectively, an illustration of the substantially spherically-shaped applicator 29 in contact with the skin 35 at different angles of application as needed, and a schematic diagram of the vector forces developed by applicator 29. As will be appreciated from the following description, the electronic control circuitry enables a wide variety of movements of applicator 29 against the skin, to achieve any desired pattern of physical stimulation.

As shown in FIG. 2, the mode of contact between applicator 29 and the skin 35 can be varied by variation of the contact angle, for deriving different physical stimulation effects from the movements generated by device 10. Thus, for small skin areas, a stationary application is used, in which applicator 29 is perpendicular to the skin 35. For a larger area, applicator 29 advances along the skin 35 with rotation, and as described further herein, this rotation may be interrupted, uneven reversible rotation, causing gentle stretching of the skin.

Figure 4:
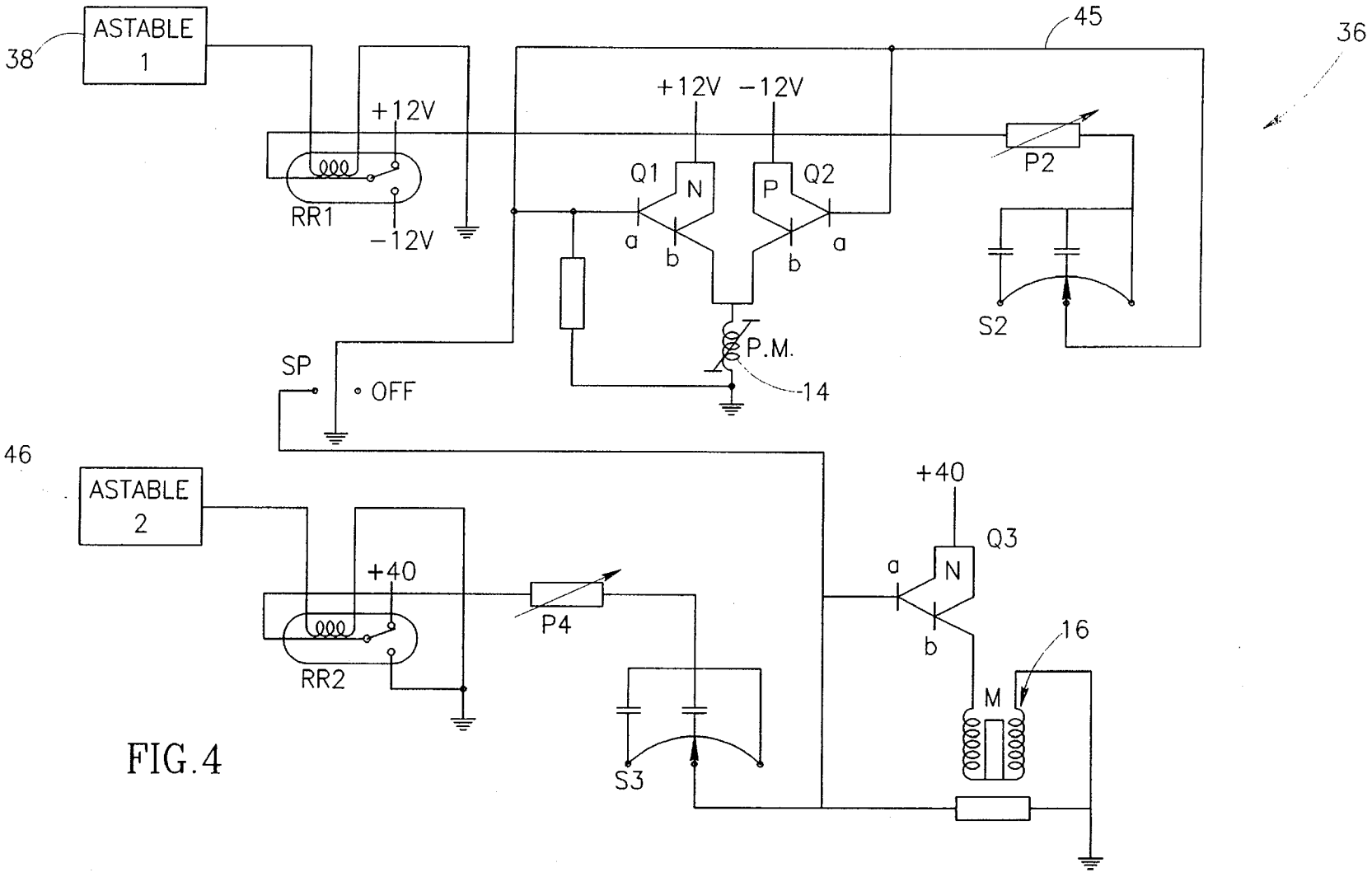
FIG. 4 is an electronic block diagram of a control circuit for the stimulation device of FIG. 1.

Referring now to FIG. 4, there is shown an electronic block diagram of a control circuit 36 for stimulator device 10. Circuit 36 comprises two control sections for controlling movements of applicator 29, one associated with reversible rotation of motor 14 to provide horizontal movement, and the other associated with vertical movement of solenoid 16. The horizontal section uses astable multivibrator 38 to produce an output frequency which controls the timing operation of a reed relay RR1 (SPDT), to drive rotation of motor 14 via a ±12 volt drive signal 45 which is transferred through potentiometer P2 and capacitor switch 2 to drive the output of Darlington transistor pairs Q1*a–b*, Q2*a–b*, connected in a common emitter configuration.

The vertical control section uses astable multivibrator 46 to produce an output frequency which controls the timing operation of a reed relay RR2 (SPDT), for controlling solenoid 16 via a 40 volt energizing signal which is transferred through potentiometer P4 and capacitor switch S3 to drive the output of a Darlington transistor pair Q3*a–b*. In the alternative embodiment shown in FIG. 6, the digital input drives transistor pair Q3*a–b* via the input at point B, and jumper 47 is removed.

A mode selector switch SP can be used to select alternate operational modes, by neutralizing the signal to the non-selected mode, or to select combined vertical and horizontal modes by movement of the selector switch to the "off" position.

Figure 5A:
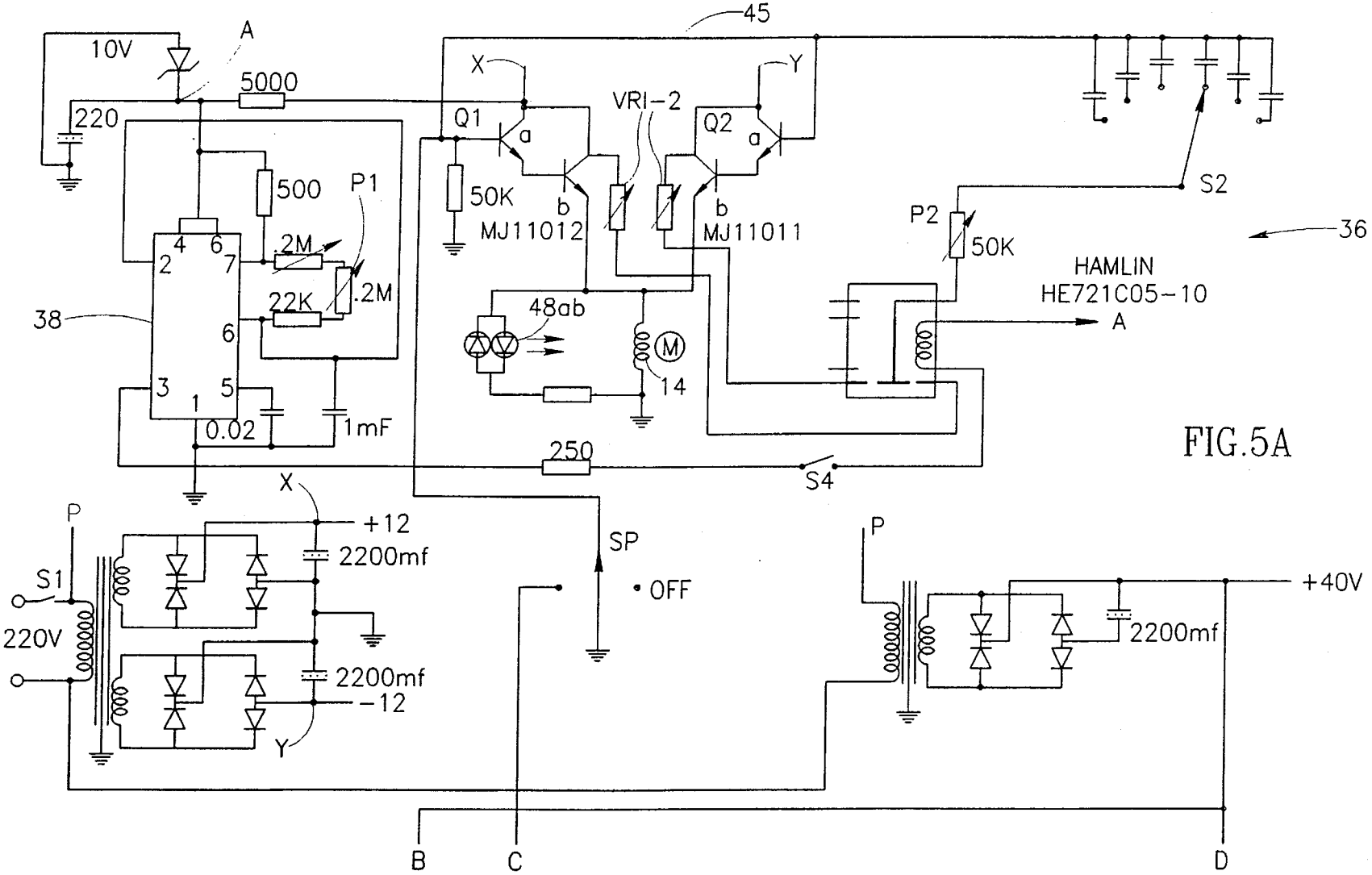
FIG. 5 is an electronic schematic diagram of the control circuit of FIG. 4.
Figure 5B:
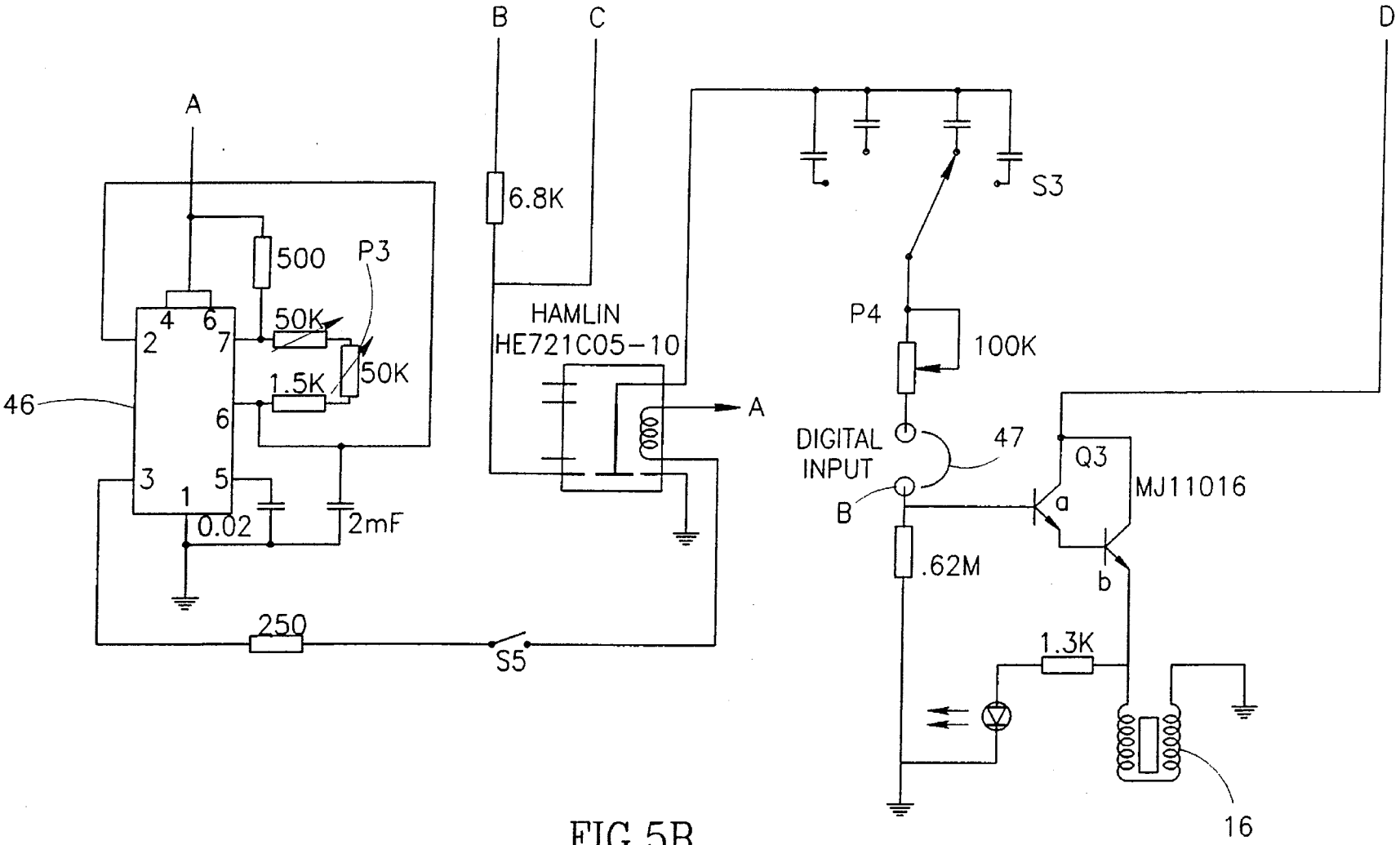

Referring now to FIG. 5, there is shown an electronic schematic diagram of the control circuit 36 for control of stimulation device 10. The device may be designed for operation on 110/220 VAC input power, with power supply conversion and rectification of the input to provide ±12 volt DC and +40 volt DC output. The overall design shown can be readily achieved based on skill of the art electronic design techniques.

Astable multivibrators 38, 46 may be implemented using a Motorola type 555 timer IC. The duty cycle of operation of astable multivibrator 38 in the first control section is approximately 50%, or symmetrical, and the frequency of operation may be varied by adjustment of potentiometer P1. The typical range of frequencies is such as to provide motor 14 with a rotation rate of between approximately 0.5 to 120 rotations/sec.

In the embodiment shown in FIG. 5, motor 14 is operated as a reversible direction motor, based on operation of relay RR1. Switch 4 feeds the timing information from pin 3 of multivibrator 38 for operation of relay RR1, and if opened, the timing information is interrupted, maintaining relay RR1 in one position, and causing interrupted rotational movement. LEDs 48*a–b* are arranged to indicate the direction of rotation of motor 14.

The typical rotation movement of motor 4 is an interrupted circular movement, where the right and left-handed rotational deflection are equal, based on the timing of relay RR1. Forward and backward movement can be obtained in this fashion. However, for purposes of developing physical stimulation by advancing applicator 29 along the skin, the rotational deflection of motor 14 is controlled in an uneven fashion, such that the left turn is slightly longer than the right turn.

Thus, the movement of applicator 29 along the skin can be achieved by these uneven deflection movements, with each deflection expressed as percentage of a full rotation. The percentages can be varied by adjusting the resistance ratio between potentiometers VR1–VR2, which controls the current flow via the collectors of Darlington transistor pairs Q1*a–b* and Q2*a–b*. The rotation of motor 14 with a predetermined rotational deflection is important for gentle stretching of the skin, as part of skin therapeutic treatment.

In order to achieve integrated and fine control of motor 14, drive signal 45 can be attenuated to control motor 14 torque by potentiometer setting P2, and the rotation deflection can be modified by the capacitor selected by S2. For example, five of the six positions shown on switch S2 determine the amount of rotation deflection as exponential, not linear movement. The sixth position has no capacitor, and provides linear movement.

This feature of the control of device 10 is also useful to develop passive exercise of muscle fibers. For example, device 10 can be operated using even, bi-directional rotation, with a rotation frequency of approx. 2–30 rotations/sec, at 250–350 gram torque, to contract several longitudinal muscle filaments. Reflex therapy uses the technique of light stretching of the plantar surface of the foot to initiate the proprioceptive reflexes. Medical manipulation of the deep underlying tissue can be performed with even bi-directional rotation, at a rotation frequency of approx. 2–20 rot/sec, and a torque of 100–250 grams.

Astable multivibrator 46 in the vertical control section controls the timing operation of relay RR2. The duty cycle of operation of astable multivibrator 46 is approximately 50%, or symmetrical, and the frequency of operation may be varied by adjustment of potentiometer P3. The typical range of frequencies is such as to provide solenoid 16 with a frequency of vertical movements in the range of approx. 1 to 5 movements/sec.

The pressure developed by vertical movement of applicator 29 against the skin can be controlled by potentiometer P4 adjustment, to determine the energization level and lifting power of solenoid 16, in lifting movable iron core portion 22, to which motor 14 is attached. Capacitor switch S3 determines the time ratio between the rest and energized positions of solenoid 16. The result is an interrupted, reciprocating vertical movement, providing skin and tissue stimulation.

An example of a medical treatment procedure using stimulation device 10 is now described. In the case of arthritis or rheumatoid arthritis, the treatment attempts to increase the circulation and metabolism. The inventive stimulation device 10 can be used in combined therapy with a warm bath which leads to an improvement of the method. The limb, hand or leg can be placed in a warm bath, and applicator 29 of stimulation device 10 can be applied to the affected area. Above the places of the subcutaneous rheumatoid nodules, gentle stimulation can be provided by applying a slight pressure to the area adjacent the nodules, with applicator 29 at approximately a 90 degree angle to the skin 35. The probe can be moved around the nodules and over the nodules. Stimulation device 10 can be set with capacitor switch S2 to one of positions 3–5, with even or uneven forward and backward (bi-directional) rotational frequency of about 10 rotations/sec, and then about 25 rotations/sec, for approximately another 2–3 minutes.

In case of a spasmodic condition of the muscle, as a result of arthritis (flexion contracture) the following methods are recommended:

a) localization of the muscle group which is responsible for the contracture;

b) placement of applicator 29 above the localized muscle, at about a 45 degree angle to the skin 35;

c) development of forward movement (about 20 rotations/sec) and backward movement (about 16 rotations/sec);

d) adjustment of the power until a slight pain occurs (100–300 grams torque), and readjustment of the power below this level for passive exercise of the relevant muscle group.

An example of a cosmetic treatment procedure using stimulation device 10 is now described. Treatment of facial skin, to improve capillary circulation and tissue condition, and reduce wrinkles, can be effected by stimulating and activating the facial muscles, to increase support of the skin surface by the muscles. For this purpose, a two phase treatment is used:

Phase I—applicator 29 is applied to skin surface 35 at a 90 degree angle, and set for uneven bi-directional movement frequency of about 16 rotations/sec forward, and about 12 rotations/sec backward. The power can be adjusted from 0 gram torque to approx. 50% (200 gram torque) of the maximum power (400 gram torque), with the area of application using a slow circular movement for approx. 2 minutes. If vertical movements are also used, these should be adjusted to approximately 10 movements/sec with medium power.

Phase II—applicator 29 is applied at approx. a 30–45 degree angle to skin surface 35, and a forward movement frequency of approx. 30–50 rotations/sec is developed, with a backward movement frequency of approx. 25–30 rotations/sec, in an area of application using longitudinal movement above skin surface 35 for about 2 minutes. In Phase I, cream is used on applicator 29; in Phase II it is dry.

Figure 6:
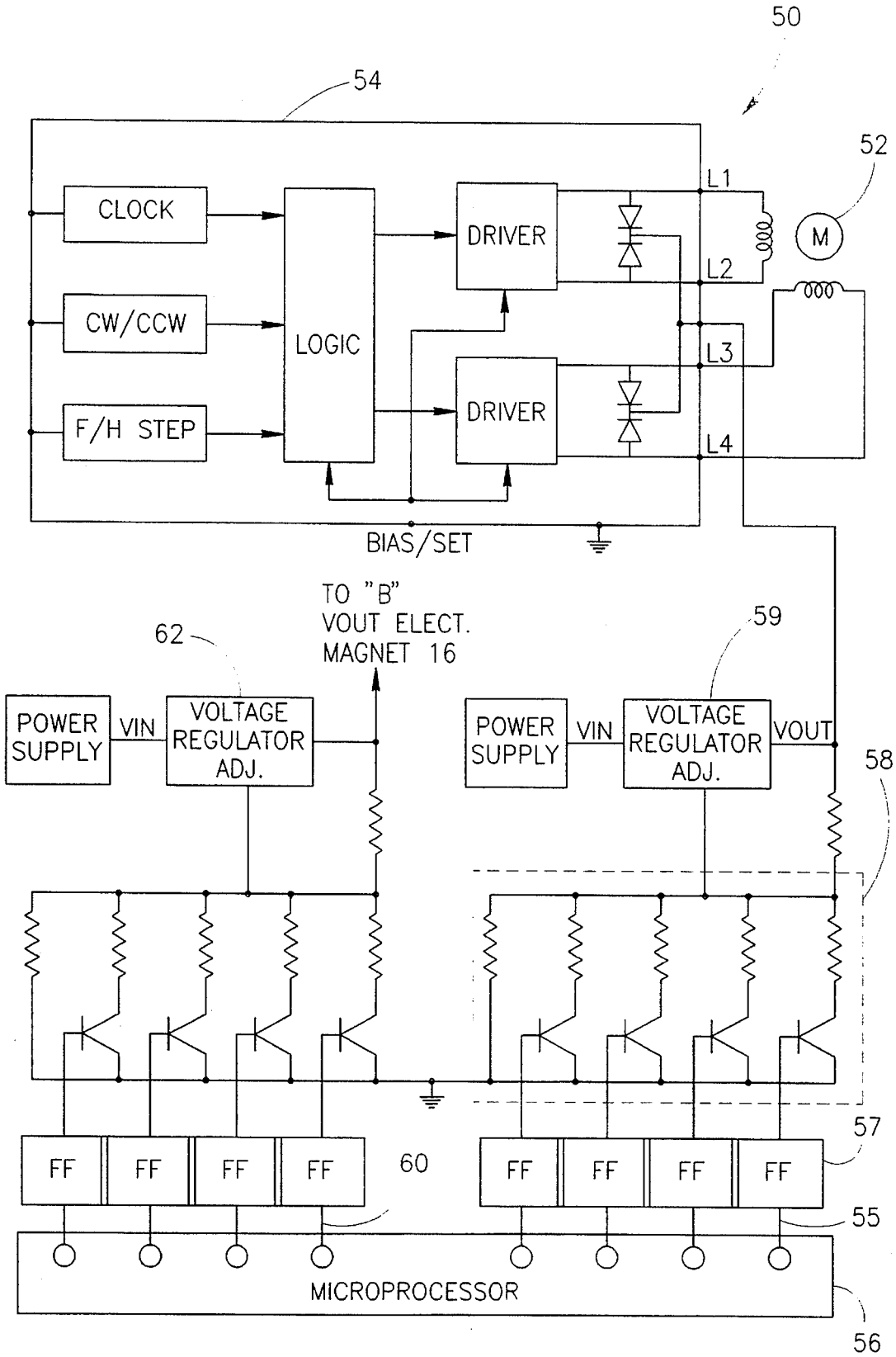
FIG. 6 is an alternative electronic schematic diagram of a control circuit using a stepmotor in the device of FIG. 1.

Referring now to FIG. 6, there is shown an electronic schematic diagram of an alternative control circuit 50 for use with a stepmotor 52 in the inventive stimulation device 10. Control circuit 50 provides a digital control system, based on use of a stepmotor driver 54 integrated circuit chip such as type SAA1042 or MC 3479 available from Motorola. The full range of motor control functions can be obtained by use of driver 54, including clockwise (CW) and counterclockwise (CCW) rotation, and full or half (F/H) step rotation.

The output current of stepmotor driver 54 (L1-L2, L3-L4) is controlled by a 4-bit digitally selected output determined by digital inputs 55 (horizontal) from a microprocessor 56, which control flip-flops 57 and transistor drivers 58. Transistor drivers 58 adjust the voltage applied to regulator 59 (first bit min. voltage, last bit max. voltage), which provides an output voltage $V_{out}$ to the stepmotor driver 54 input. Similarly control out of solenoid 16 is provided by digital inputs 60 (vertical) controlling the application of voltage to voltage regulator 62, which provides an output voltage $V_{out}$ to solenoid coil 18.

Figure 7:
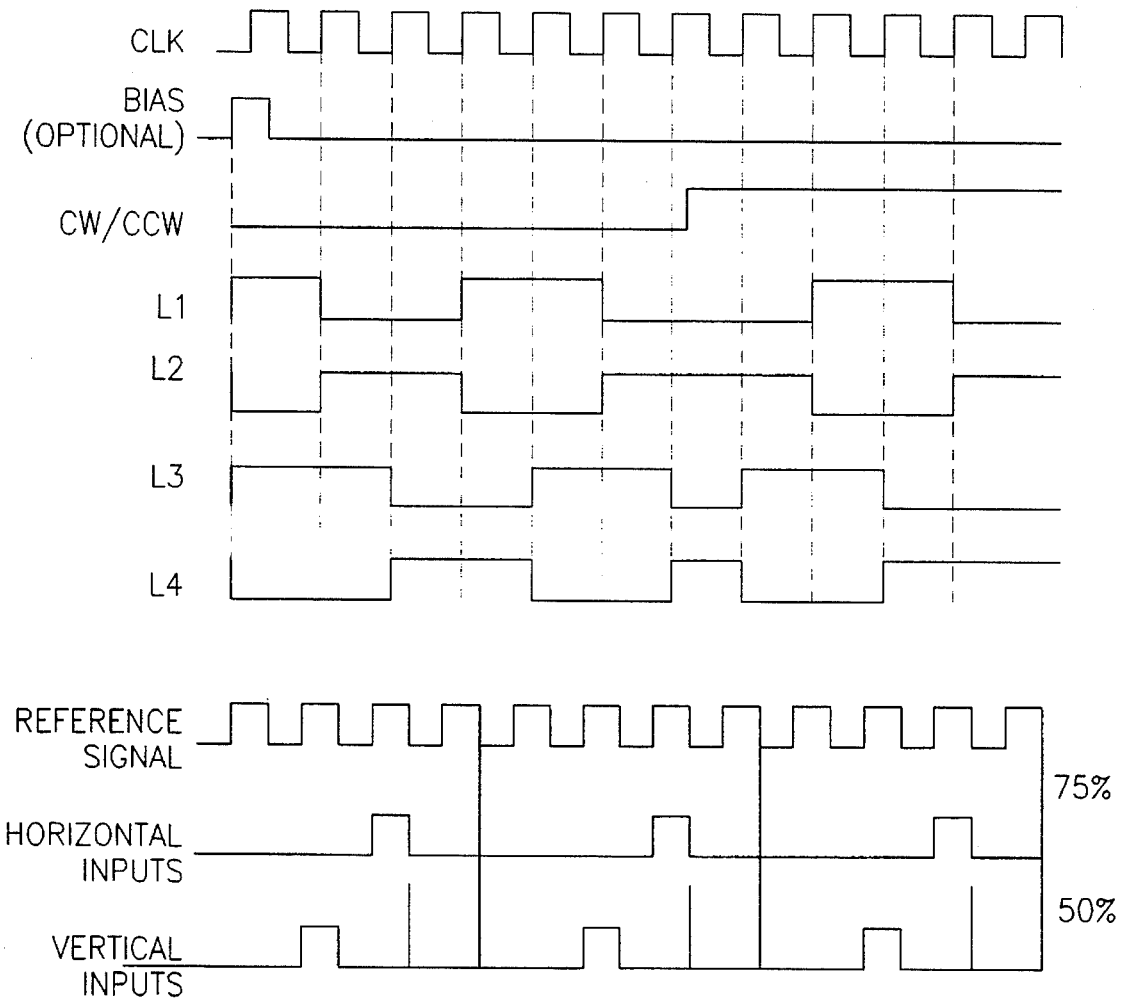
FIG. 7 is a timing diagram of FIG. 6 circuit operation.

Stepmotor driver 54 operates in accordance with the pulse timing diagram of FIG. 7, and its operation can be programmed in advance by application of predetermined pulse waveforms providing digital inputs 55, 60. The pulse waveforms can be generated in a program sequence run as a software program, in microprocessor 56. Thus, for specific treatments, device 10 can be operated automatically in accordance with a treatment method established and preprogrammed in advance.

In summary, the different kinds of receptors in the tissue can be selectively activated by device 10, since they are frequency dependent and direction-force dependent. A localized area may be treated, and individually adjustable horizontal movements can be preprogrammed, to activate the center point of a skin area, or to refresh a larger surface area. Separate or simultaneous movement of applicator 29 enables a large variety of stimulation effects, as part of cosmetic or medical treatments.

In addition, the applicator can be applied against the skin under fluids containing medical ingredients, or with creams, using various applicator shapes for different applications.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

We claim:

1. A skin and tissue treatment and stimulation device comprising:

a housing;

electromechanical transducer means mounted in said housing, said electromechanical transducer means having applicator means mounted at an end thereof, said applicator means contacting the skin and tissue; and control means for applying electrical signals to said transducer means to control movement thereof, for controlled manipulation of the skin and tissue via said applicator means;

wherein said transducer mean comprises:

a rotation-reversible motor; and an electromagnetic solenoid comprising a fixed portion and a slidably movable portion, said motor being connected to said slidably movable portion so as to move therewith, said applicator means being mounted on a shaft of said motor, such that said applicator means is reversibly rotatable, and vertically movable, said reversibly rotatable applicator means being rotatable in each of forward and reverse rotation directions with a controllable rotational deflection angle, at a controllable rotation rate and torque.

2. The device of claim 1 wherein the shaft of said motor is in-line with a central axis of said slidably movable portion.

3. The device of claim 1 wherein said control means comprises electronic circuitry comprising a pair of astable multivibrators each generating a pulsed, square-wave signal at a continuously variable, integrated and finely controllable amplitude and frequency, each of said signals providing control of said motor and solenoid movements, for control of said applicator means movement.

4. The device of claim 3 wherein said electronic circuitry comprises a microprocessor having a preprogrammed control sequence for controlling movement of said transducer means.

5. The device of claim 1 wherein said reversibly rotatable applicator means is rotatable in each of said forward and reverse rotation directions with said rotational deflection angle being of one of said directions uneven to that of the opposite direction, such that said applicator means advances horizontally, stretching the skin.

6. The device of claim 1 wherein said applicator means is vertically movable in reciprocal fashion with a controllable force and frequency, to apply a desired pressure to the skin.

7. The device of claim 1 wherein said applicator means comprises a substantially spherically-shaped tip formed of a soft material for contact with the skin and tissue at a desired contact angle.

8. The device of claim 1 wherein said motor rotational torque is controllable within a range of approximately 0–400 grams torque for gentle stretching of the skin and tissue.

9. The device of claim 1 wherein said rotational rate is controllable within a range of approximately 0.5–120 rotations/sec.

10. The device of claim 1 wherein said applicator means has a surface area adapted for manipulation of a selected skin area.

11. The device of claim 1 wherein said housing is compact, portable, and hand-held.

12. A method of treatment of skin and tissue using a stimulation device, said method comprising the steps of:

providing an electromechanical transducer means mounted in a housing, said transducer means comprising a rotation-reversible motor having applicator means mounted on an end of its shaft, said applicator means contacting the skin and tissue; and applying electrical signals to said transducer means to control movement thereof, for controlled manipulation of the skin and tissue via said applicator means, wherein said reversibly rotatable applicator means is rotated in each of forward and reverse rotation directions with a controllable rotational deflection angle, at a controllable rotation rate and torque, said reversibly rotatable applicator means being rotated in each of said forward and reverse rotation directions with said rotational deflection angle being of one of said directions uneven to that of the opposite direction, such that said applicator means advances horizontally, stretching the skin.

13. The method of claim 12 wherein said controlled manipulation is performed by said transducer means further comprising:

an electromagnetic solenoid comprising a fixed portion and a slidably movable portion, said motor being connected to said slidably movable portion so as to move therewith, said applicator means being mounted on the shaft of said motor, such that said applicator means is reversibly rotated, and vertically movable, as selected in said step of applying said electrical control signals.

14. The method of claim 13 wherein said applicator means is vertically movable in reciprocal fashion with a controllable force and frequency, to apply a desired pressure to the skin.

15. The method of claim 12 wherein said applying step is performed by electronic circuitry comprising a pair of astable multivibrators each generating a pulsed, square-wave signal at a continuously variable, integrated and finely controllable amplitude and frequency, each of said signals providing control of said transducer means for control of said applicator means movement.

16. A skin and tissue treatment and stimulation device comprising:

a housing;

electromechanical transducer means mounted in said housing, said electromechanical transducer means having applicator means mounted at an end thereof, said applicator means contacting the skin and tissue; and control means for applying electrical signals to said transducer means to control movement thereof, for controlled manipulation of the skin and tissue via said applicator means;

wherein said transducer means comprises:

a rotation-reversible motor; and an electromagnetic solenoid comprising a fixed portion and a slidably movable portion, said motor being connected to said slidably movable portion so as to move therewith, said applicator means being mounted on a shaft of said motor, such that said applicator means is reversibly rotatable, and vertically movable, said reversibly rotatable applicator means being rotatable in each of forward and reverse rotation directions with a controllable rotational deflection angle, at a controllable rotation rate and torque, said reversibly rotatable applicator means being rotatable in each of said forward and reverse rotation directions with said rotational deflection angle being of one of said direction uneven to that of the opposite direction, such that said applicator means advances horizontally, stretching the skin.

17. The device of claim 16 wherein said control means comprises electronic circuitry comprising a microprocessor having a preprogrammed control sequence for controlling movement of said transducer means.

18. The device of claim 16 wherein said applicator means is vertically movable in reciprocal fashion with a controllable force and frequency, to apply a desired pressure to the skin.

19. The device of claim 16 wherein said applicator means rotational deflection is at least one of exponential and linear movement.

20. The device of claim 16 wherein said motor rotational torque is controllable within a range of approximately 0–400 grams torque for gentle stretching of the skin and tissue.

* * * * *